US006637141B1

(12) United States Patent
Weatherby et al.

(10) Patent No.: US 6,637,141 B1
(45) Date of Patent: Oct. 28, 2003

(54) GUN STOCK

(76) Inventors: Donald Weatherby, 9565 Bull Lake Rd., Troy, MT (US) 59935; John Kimball, 9457 Bull Lake Rd., Troy, MT (US) 59935

( * ) Notice: Subject to any disclaimer, the term of this patent is extended or adjusted under 35 U.S.C. 154(b) by 0 days.

(21) Appl. No.: 10/124,435

(22) Filed: Apr. 16, 2002

(Under 37 CFR 1.47)

(51) Int. Cl.[7] ..... F41A 21/00
(52) U.S. Cl. ..... 42/75.03
(58) Field of Search ..... 42/75.03, 74, 72

(56) References Cited

U.S. PATENT DOCUMENTS 194,489 A * 8/1877 Walis ..... 42/72
2,583,260 A * 1/1952 Felix ..... 42/126
2,825,138 A * 3/1958 Ivy ..... 42/124
3,323,246 A * 6/1967 Loffler ..... 42/75.01
4,021,954 A * 5/1977 Crawford ..... 42/127
4,788,785 A * 12/1988 White ..... 42/72
5,173,564 A * 12/1992 Hammond, Jr. ..... 42/75.03
5,333,404 A * 8/1994 Lingyak ..... 42/72
5,417,002 A * 5/1995 Guerra ..... 42/72

* cited by examiner

*Primary Examiner*—Michael J. Carone
*Assistant Examiner*—Denise J Buckley
(74) *Attorney, Agent, or Firm*—Michael J. Tavella

(57) ABSTRACT

An improved gun stock construction that substantially reduces both the recoil and the tendency of the gun to move upward or jerk when it is fired. The stock is formed with two sections having a flexible hinge mechanism. This structure creates a moment arm or couple which opposes the tendency of the gun to move upward when it is fired. This invention relates to improvements in a gun construction and more particularly to the improvement in gunstock that permits better control of the gun by the operator.

17 Claims, 9 Drawing Sheets

GUN STOCK

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the invention

This invention relates to gunstocks and particularly to gunstocks having two sections in pivotal relation to each other.

2. Description of the Prior Art

The prior art teaches that it is commonly known that the recoil of a gun causes the barrel to shift in a generally upward direction and to the left. In an automatic gun which is firing rapidly, this becomes a force which is practically uncontrollable so that effective use of the weapon is not always possible after the first few shots when rapid firing is being used.

Attempts have been made to reduce this effect. One example is found in U.S. Pat. No. 3,388,494 to John Kimball, a coninventor of the instant invention. That patent disclosed a gun stock that has a stock formed from two sections having a flexible strap interposed between the sections adjacent to the top of the stock and a spring between the sections below the strap so that the two sections can rotate in a segment of an arc relative to each other and to -the top of the stock. This structure creates a moment arm or couple, which opposes the tendency of the gun to move upward when it is fired.

BRIEF DESCRIPTION OF THE INVENTION

Despite the improvements in this design, there are still problems with it. The instant invention is an improvement over this design. It replaces the flexible strap at the top, which tends to bend in a random pattern with a pin hinge that precisely controls the arc of travel, which produces a precise placement in relation to the barrel centerline.

The new device is self-adjusting and does not have to be adjusted for different ranges. This is done through the manipulation of a set constant applied force.

The system uses an interlocking mechanism that adds rigidity to the stock.

Finally, it uses the combination of springs and rubber membranes as a two-step mechanism, which produces a smoother operation.

In its basic form, the gunstock has a front piece that attaches to the front part of the weapon and a rear piece that forms the butt of the stock. These two pieces are attached at the top at a pivot point that allows the two pieces to swing in an arc. A pin is placed in a track in the rear piece and is fitted with a spring. The distal end of the pin has a flat head that fits into the bottom of the front piece. Here, the head of the pin is held securely. This pin and spring are designed to allow restricted movement of the rear portion with respect to the front portion as the weapon is fired. This produces an oscillation that absorbs the moment forces that would normally pitch the gun upwards.

It is an object of the present invention to provide an improved gun stock which not only reduces to a very minimum the change of position of the muzzle of the gun in continued firing but also relieves the shock against the shoulder of the gunner making it possible for the operator to maintain a stable position with a well-aimed firearm under rapid firing conditions.

Another object of the invention is a control device for a gunstock that is readily-adjustable depending on the ammunition used and the needs of a particular operator.

It is a further object of the invention to provide a fully-automatic, shoulder-fired weapon which converts recoil energy into a beneficial effect which results in dropping the barrel and bringing it back into the previously mounted position. Thus, the general tendency of the barrel to rise after each shot is eliminated; and, as a secondary advantage, there is dampening of the recoil in the absorption of the energy to accomplish the beneficial result causing less disturbance of the gunner and the gun attitude.

DETAILED DESCRIPTION OF THE INVENTION

Figure 1:
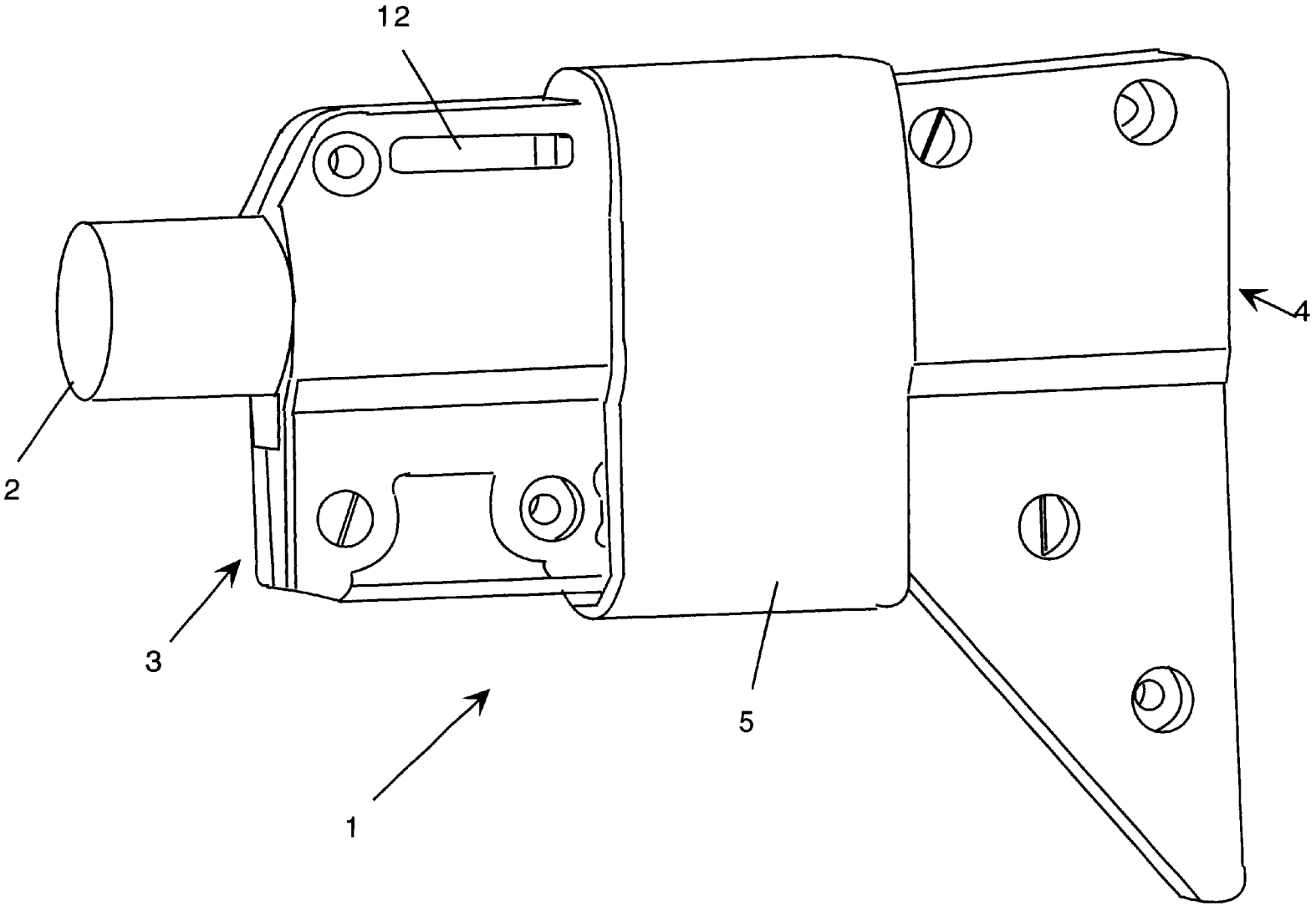
FIG. 1 is a perspective view of the assembled gunstock.

Referring now to FIG. 1, the new gunstock 1 is shown fully assembled. The gunstock has four main parts. First this receiver extension 2 that secures the stock to the main part of the weapon. Second is the stationary portion 3. Third is the rotating portion 4. And the last element is a sleeve 6. A slot 12 is used for a gun sling.

Figure 2:
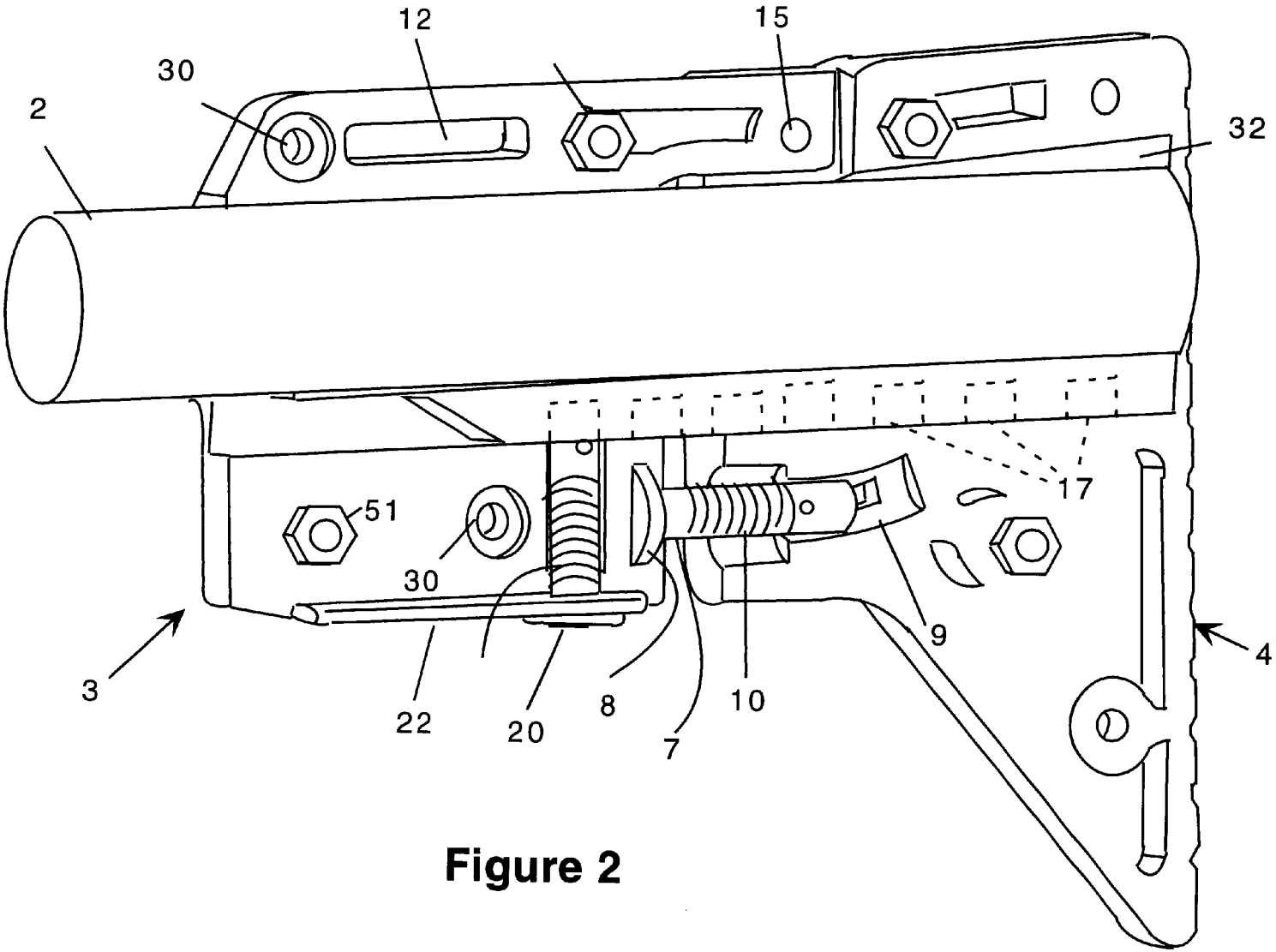
FIG. 2 is a perspective view of the internal structure of the right side of the gunstock.

FIG. 2 shows the interior of the right side of the assembly. The receiver extension 2 fits into a recess in both the stationary and rotating portions. The stationary portion 3 is attached to the rotating portion 4 at two places. First, a pivot pin 6 (see FIG. 22) that passes through holes in both the stationary portions 3 and the rotating portion 4 forms a pivot point 5. If the receiver extension were not in place, this pivot would allow the stationary portion 3 and the rotating portion 4 to pivot freely about the pin. The second point of attachment is at the sliding spring pin 7. The head of the sliding spring pin 7 is held in a slot 8 formed in the stationary portion 3 as shown. The end of the spring pin 7 extends back to meet a channel 8 in the rotating portion 4. Note that the channel 8 is curved. This allows the rotating portion 4 to rotate instead of sliding in a flat plane. A spring 10 is used to return the rotating portion to its starting position for the next recoil. FIG. 2 also shows a second spring pin 20 that is an adjustment pin. An adjustment pin lever 22 is also shown. Note that the function of these two components is discussed below.

In the preferred embodiment, the device is made from cast parts. Thus, the figures show typical structures found in casting.

Figure 3:
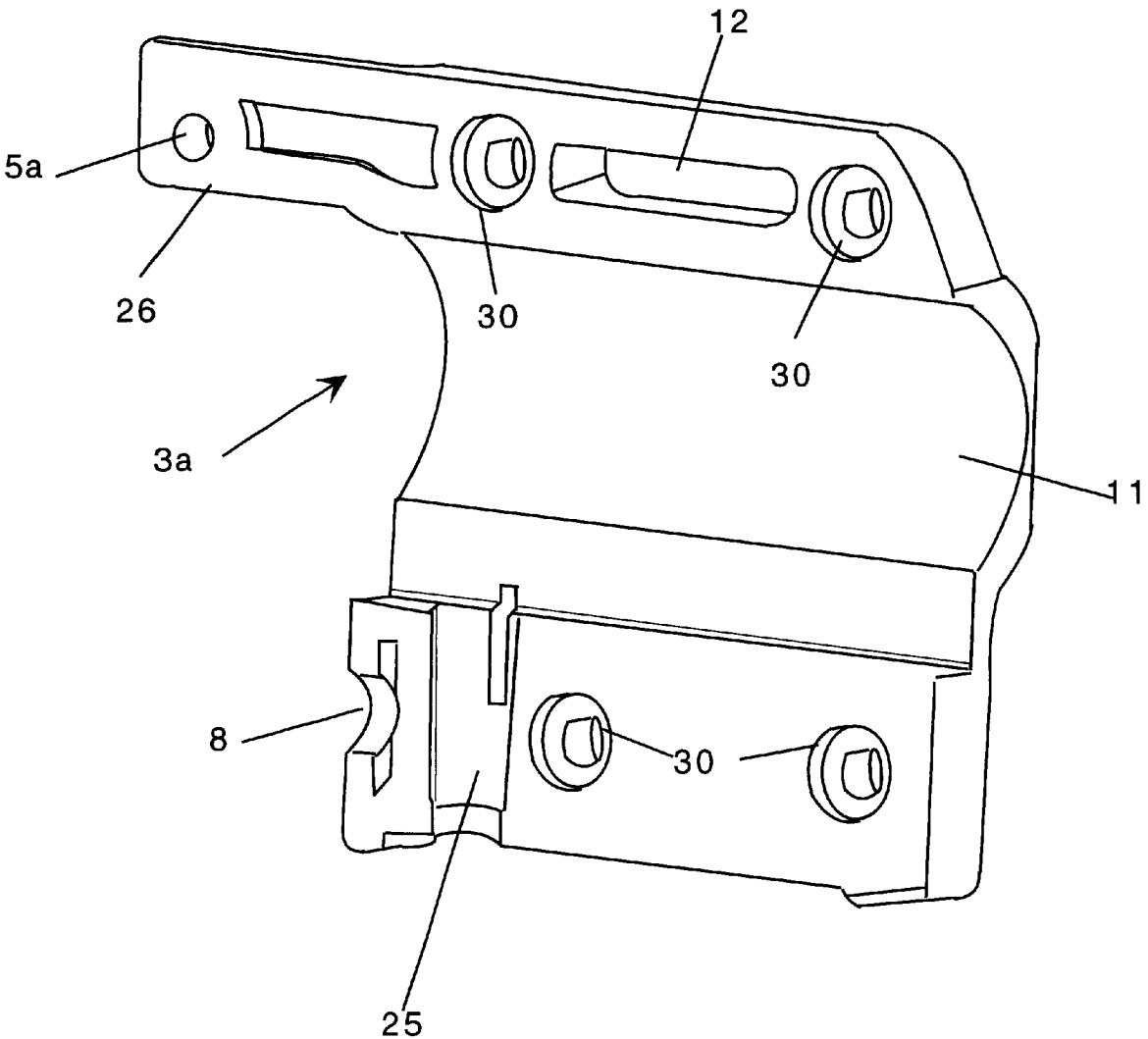
FIG. 3 is a perspective view of the inside of the left side of the stationary section.
Figure 4:
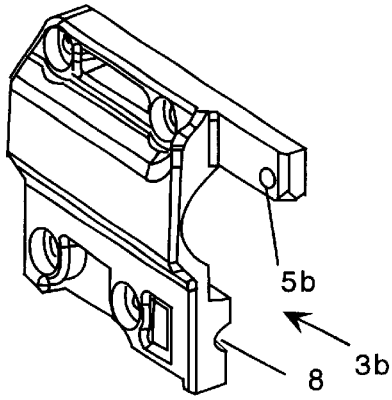
FIG. 4 is a perspective view of the outside of the left side of the stationary section.
Figure 5:
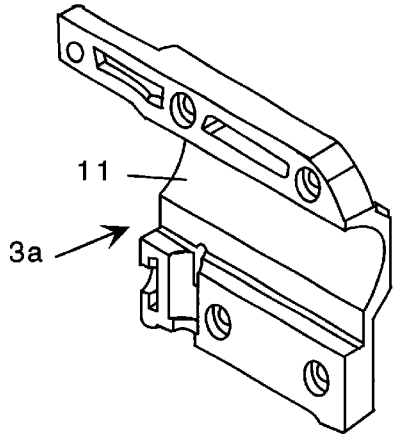
FIG. 5 is a second perspective view of the inside of the left side of the stationary section.
Figure 6:
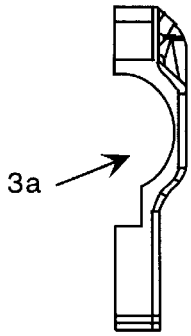
FIG. 6 is an end view of the left side of the stationary section.

FIG. 3 shows the left side of the stationary portion 3*a*. FIG. 4 shows the right side 3*b*. In this figure, the slot 11 for the receiver extension and the slot 12 for the sling are shown. The slot 8 for the head of the spring pin 7 is shown. Behind that slot is a vertical channel 25 that holds the adjustment pin 20 as discussed below. Under that channel is a small recess 23 in which the adjustment lever 22 is placed. Note also that the piece has a number of openings 30 for fasteners 50. These fasteners are shown in other figures (e.g., FIG. 2). Note that the stationary portion 3 has an engagement arm 26 that aligns with the rotating portion 4. The hole 5*a* is the pivot point in the stationary portion 3. Through here, the pivot pin 6 is placed.

Figure 7:
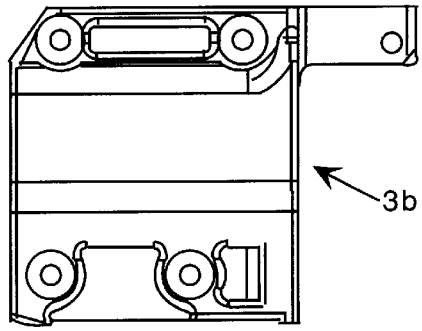
FIG. 7 is a side view of the outside of the right side of the stationary section.
Figure 8:
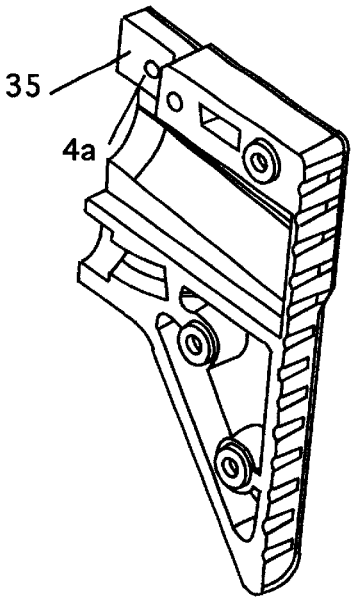
FIG. 8 is a perspective view of the inside of the right side of the rotating section.
Figure 9:
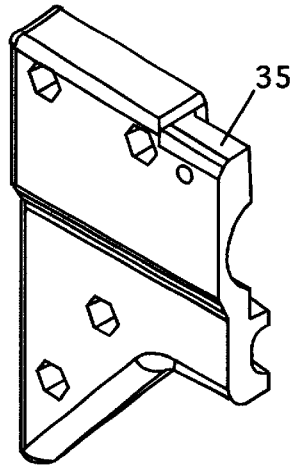
FIG. 9 is a perspective view of the outside of the right side of the rotating section.
Figure 10:
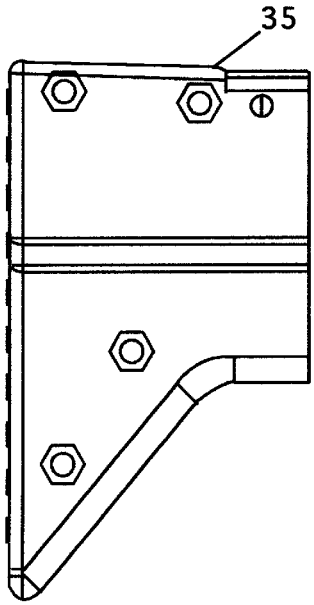
FIG. 10 is a side view of the outside of the right side of the rotating section.

FIGS. 4-7 show additional views of the stationary portion. FIG. 4 shows the right side pivot hole 5*b* that aligns with pivot 5*a*. Figures and 6 show views of the left side 3*a*. FIG. 7 is a side view of the right side 3*b*.

Figure 11:
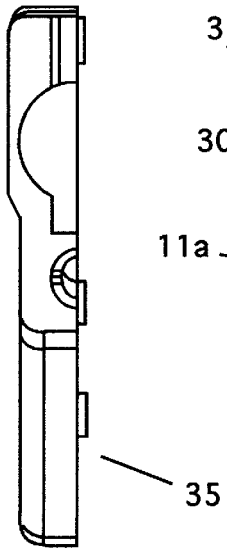
FIG. 11 is an end view of the right side of the rotating section.

FIGS. 8–12 show details of the rotating portion. Note that these views show only one side. The other side is a mirror image. FIG. 11 shows a front view of the side.

Figure 12:
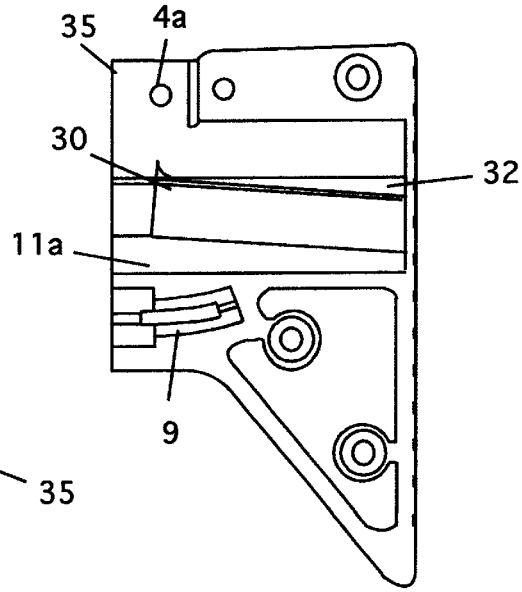
FIG. 12 is a side view of the inside of the right side of the rotating section.
Figure 13:
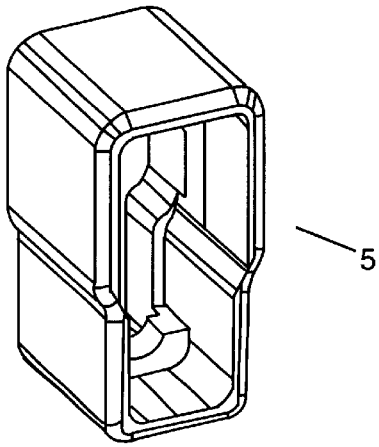
FIG. 13 is a perspective view of the right side of the sleeve section.
Figure 14:
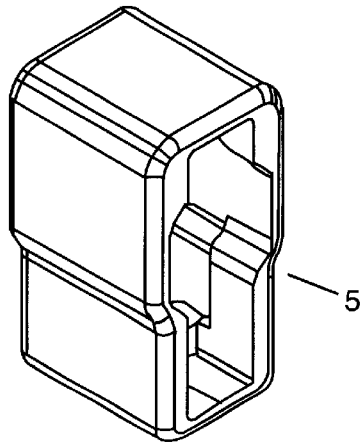
FIG. 14 is a perspective view of the left side of the sleeve section.
Figure 15:
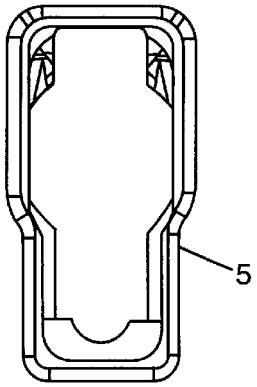
FIG. 15 is a right end view of the sleeve section.
Figure 16:
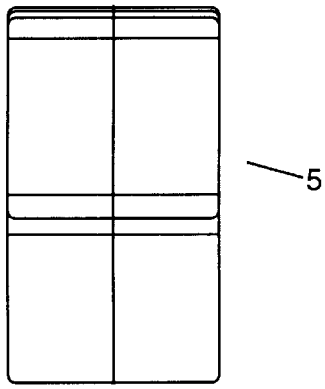
FIG. 16 is a side view of the sleeve section.
Figure 17:
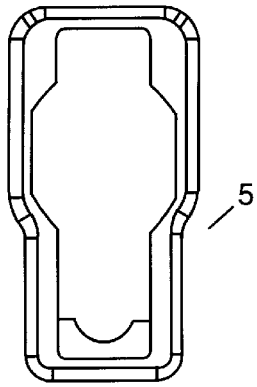
FIG. 17 is a left end view of the sleeve section.
Figure 18:
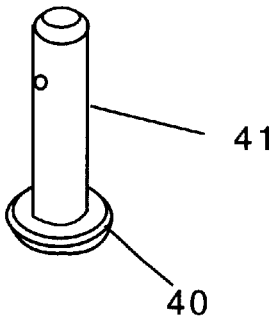
FIG. 18 is a perspective view of the spring pin.
Figure 19:
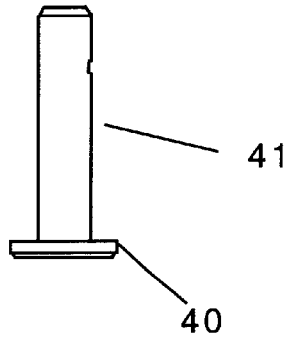
FIG. 19 is a side view of the spring pin.
Figure 20:
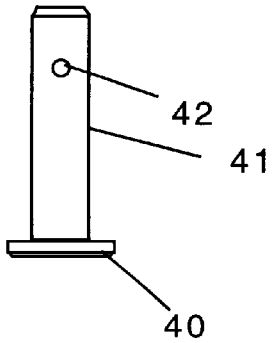
FIG. 20 is a side view of the spring pin rotated 90 degrees from FIG. 19.
Figure 21:
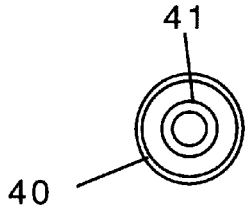
FIG. 21 is a top view of the spring pin.

As shown in FIG. 12, the curved slot 9 for the spring pin is shown. This slot works to cause the rotating part of the stock to rotate on recoil. As the rifle recoils, it pushes backward. Because the rotating portion is not fixed, the movement causes the spring pin 7 to slide along the channel 9. As it does so, the rotating portion pivots about the pivot pin. This causes the muzzle of the rifle to drop, which counters the natural tendency for the muzzle to rise. The spring 10 forces the forward part of the gun forward so that the stock is ready to receive the next recoil.

Note that the channel 11*a* for the receiver extension has a triangular gap 30 formed at the back. As shown in FIG. 2, the gap is above the receiver extension when it is in place. This gap is necessary to provide space for the rotating portion to rotate without being impeded by the receiver extension. Otherwise, the rotating portion would be held rigidly by the receiver extension and the offsetting rotation to counter the lifting moment of the muzzle could not be developed.

Note also that the rotating portion 4 also has a recessed portion 35 that accepts the engagement arm 26 of the stationary portion 3. A hole 4*a* is used to hold the pivot pin 6, as discussed above. This forms the pivot point for the entire assembly.

FIGS. 13–17 show details for the sleeve 5. Due to the structure of the parts, the front half of the sleeve is designed to conform to the shape of the stationary portion and the back half of the sleeve is designed to conform to the rotating portion. The purpose of the sleeve is to fit over the joined parts to present a finished appearance and to protect the user from the moving elements when in use. The sleeve can be molded in two pieces and joined at the center as shown. Of course, the interior shape of the sleeve can be made to conform to whatever shape the other components may take, or as needed to fit different weapon configurations.

FIGS. 18–21 show details of the spring pin and the adjustment pin 20. These pins 7 and 20 have a flat head 40 and a vertical shaft 41 as shown. A hole 42 is placed through the distal end of the vertical shaft 41. The hole 42 is used to secure a spring 10 when it is installed.

Figure 22:
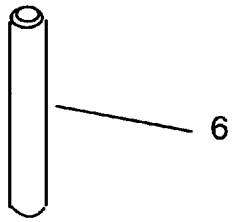
FIG. 22 is a perspective view of the pivot pin.
Figure 23:
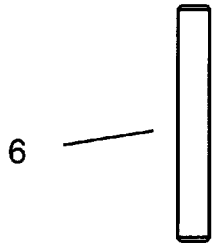
FIG. 23 is a side view of the pivot pin.
Figure 24:
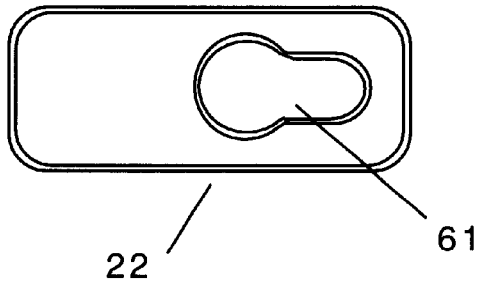
FIG. 24 is a top view of the spring pin lever.

FIGS. 22 and 23 show the pivot pin 6. This pin is a simple cylindrical pin that has beveled edges on the top and bottom. It has a length sufficient to fit between the joined stationary and rotating parts.

Figure 25:
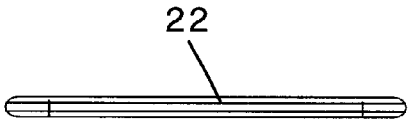
FIG. 25 is a front view of the spring pin lever.
Figure 26:
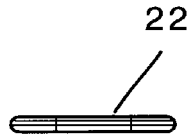
FIG. 26 is a side view of the spring pin lever.

FIGS. 25–27 show details of the adjusting lever 22. This lever is a flat bar that has a keyhole 60 formed in it. The adjustment lever is used in concert with the adjustment pin 20. This pin 20 and lever 22 are used to position the gunstock on the receiver extension. As shown on FIG. 2, the lower part of the receiver extension 2 is fitted with a number of detents 17. In FIG. 2, the pin 20 is sitting in the first detents. Receiver extensions have varying numbers of detents. Typically ranging from 4 to 7. The detents 17 allow the stock to be place along the receiver extension in a number of positions by simply moving the adjustment pin 20 from one detent 17 to another. The adjustment lever 22 is designed to do this when the stock is fully assembled (as in FIG. 1). The lever disengages the pin 20 from a detent, which allows the free travel of the stock to the next detent, or to any one of the detents desired. The adjustment pin and lever are the only means for positioning and holding the gunstock in any given position along the length of the receiver extension.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

We claim:

1. A gun stock for a fully-automatic gun having a receiver tube comprising:

(a) a two-section support in which the sections are associated for relative motion about an axis transverse to the line of fire and adjacent the top of the support, said sections being spaced to permit dosing of a gap below said axis in response to recoil force of said gun, the closing of a gap below said axis being considered as a closing action;

(b) a means for securing said receiver tube within said two-section support, wherein said receiver tube having a recoil force line below said axis, and (c) a means for resiliently resisting said closing action, such that when the recoil energy moves the gun barrel down after each shot, the reaction of said means for resiliently resisting said closing action moves the gun barrel up to the original attitude;

(d) wherein said means for resiliently resisting said closing action including at least one pin positioned in an arcuate channel, said arcuate channel being formed in said two section support and being positioned below said axis.

2. The gun stock of claim 1 further comprising a spring, operably engaged about said pin, such that said spring causes said pin to move forward in said arcuate channel when the recoil is absent during the firing of said fully-automatic gun.

3. The gun stock of claim 1 wherein the two-section support is made of molded material.

4. The gun stock of claim 1 wherein the means for resiliently resisting said closing action further includes a pivot pin positioned in the top of said two-section support.

5. The gun stock of claim 1 further comprising a means for securing said gun stock to a desired position on said receiver tube.

6. The gun stock of claim 5 wherein said receiver tube has a plurality of detent holes formed therein; and wherein the a means for securing said gun stock to a desired position on said receiver tube comprise:

a) a slider pin, slidably engaged in said front support such that said slider pin engages one of said plurality of detents in said receiver tube;

b) a means for holding said pin slider in said detent in said receiver tube; and c) means for releasing said slider pin from said detent in said receiver tube such that, when said slider pin is released, said gun stock may be moved to a different position along said receiver tube.

7. The gunstock of claim 6 wherein the means for holding said slider pin in said detent comprise a spring.

8. The gun stock of claim 6 wherein the means for releasing said slider pin include a lever operably engaged with said pin.

9. A gun stock for a fully-automatic gun having a receiver tube comprising:

a) a rear support section, having a top, and a receiver tube channel, wherein said receiver tube channel having an axis aligned with a line of fire of said fully-automatic gun;

b) a front support section, having a top, and a receiver tube channel, wherein said receiver tube channel having an axis aligned with a line of fire of said fully-automatic gun;

c) a means for pivotably attaching said rear support to said front support at the top of said rear support and said front support;

d) an arcuate channel formed in said rear support, below said receiver tube channel;

e) a pin, having a flat head, slidably engaged in said arcuate channel; and f) a slot in said front support for receiving the flat head of said pin, whereby when said fully-automatic gun is fired, a recoil generated along said axis causes said front support to pivot with said rear support in an arcuate path defined by the movement of said pin in said arcuate channel.

10. The gun stock of claim 9 further comprising a spring, operably engaged about said pin, such that said spring causes said pin to move forward in said arcuate channel when a recoil is absent during the firing of said fully-automatic gun.

11. The gun stock of claim 9 wherein the front support and the rear support are made of molded material.

12. The gunstock of claim 9 wherein the front support and rear support are each made of two sections.

13. The gunstock of claim 9 wherein the means for pivotably attaching said rear support to said front support comprises a pivot pin.

14. The gun stock of claim 9 further comprising a means for securing said gun stock to a desired position on said receiver tube.

15. The gun stock of claim 14 wherein said receiver tube has a plurality of detent holes formed therein; and wherein the means for securing said gun stock to a desired position on said receiver tube comprise.

a) a slider pin, slidably engaged in said front support such that said slider pin engages one of said plurality of detents in said receiver tube;

b) means for holding said slider pin in said detent in said receiver tube; and c) means for releasing said slider pin from said detent in said receiver tube such that, when said slider pin is released, said gun stock may be moved to a different position along said receiver tube.

16. The gunstock of claim 15 wherein the means for holding said slider pin in said detent comprise a spring.

17. The gunstock of claim 16 wherein the means for releasing said slider pin include a lever operably engaged with said slider pin.

* * * * *